US012685417B2

(12) United States Patent
Steeman et al.

(10) Patent No.: US 12,685,417 B2
(45) Date of Patent: Jul. 21, 2026

(54) CONTROLLER FOR CONTROLLING A FLOOR CLEANING DEVICE, FLOOR CLEANING DEVICE AND NOZZLE THEREOF

(71) Applicant: VERSUNI HOLDING B.V., Eindhoven (NL)

(72) Inventors: Jonne Steeman, Eindhoven (NL); Pavan Puneet Kapoor, Eindhoven (NL)

(73) Assignee: VERSUNI HOLDING B.V., Eindhoven (NL)

( * ) Notice: Subject to any disclaimer, the term of this patent is extended or adjusted under 35 U.S.C. 154(b) by 0 days.

(21) Appl. No.: 18/845,427

(22) PCT Filed: Mar. 1, 2023

(86) PCT No.: PCT/EP2023/055132
§ 371 (c)(1),
(2) Date: Sep. 9, 2024

(87) PCT Pub. No.: WO2023/169897
PCT Pub. Date: Sep. 14, 2023

(65) Prior Publication Data

US 2025/0107680 A1 Apr. 3, 2025

(30) Foreign Application Priority Data

Mar. 7, 2022 (EP) ..... 22160515

(51) Int. Cl.
*A47L 9/28* (2006.01)
*A47L 9/04* (2006.01)

(52) U.S. Cl.
CPC ..... *A47L 9/2847* (2013.01); *A47L 9/0411* (2013.01); *A47L 9/0477* (2013.01); *A47L 9/2821* (2013.01); *A47L 9/2831* (2013.01)

(58) Field of Classification Search
None
See application file for complete search history.

(56) References Cited

U.S. PATENT DOCUMENTS

2006/0085095 A1* 4/2006 Reindle ..... A47L 9/2842 700/258
2014/0259475 A1 9/2014 Doughty
2021/0169296 A1 6/2021 Brown

FOREIGN PATENT DOCUMENTS

DE 196 17 429 A1 11/1997
DE 102007040484 A1 * 3/2009 ..... A47L 9/2847
(Continued)

OTHER PUBLICATIONS

English Machine Translation of DE-102007040484-A1.*

*Primary Examiner* — Kaj K Olsen
*Assistant Examiner* — Pradhuman Parihar
(74) *Attorney, Agent, or Firm* — Maschoff Brennan

(57) ABSTRACT

The present invention relates to a controller for controlling a floor cleaning device that comprises a nozzle configured to contact a floor, a rotatable brush arranged at the nozzle, a brush motor configured to drive the brush to rotation, and a nozzle detector configured to detect whether the nozzle contacts the floor or is lifted from the floor. The controller being configured to control the rotation of the brush by means of the brush motor; and to decrease an upper threshold of a parameter related to a torque of the brush motor, if the nozzle detector detects that the nozzle is lifted from the floor.

13 Claims, 3 Drawing Sheets

(56) References Cited

FOREIGN PATENT DOCUMENTS

| | | | |
|---|---|---|---|
| DE | 10 2018 119181 | A1 | 2/2020 |
| EP | 3 316 752 | B1 | 1/2022 |
| WO | 2017/004131 | A1 | 1/2017 |

* cited by examiner

CONTROLLER FOR CONTROLLING A FLOOR CLEANING DEVICE, FLOOR CLEANING DEVICE AND NOZZLE THEREOF

CROSS-REFERENCE TO RELATED APPLICATIONS

The present application is a U.S. National Phase application under 35 U.S.C. § 371 of International Application No. PCT/EP2023/055132, filed on Mar. 1, 2023, which claims the benefit of European Patent Application No. 22160515.7, filed on Mar. 7, 2022. These applications are hereby incorporated by reference herein.

FIELD OF THE INVENTION

The present invention relates to a controller for controlling a floor cleaning device. The present invention further relates to a nozzle for a floor cleaning device and to a floor cleaning device comprising the controller. Still further, the present invention relates to a method for controlling a floor cleaning device, and a computer program product.

The floor cleaning device according to the present invention may be a vacuum cleaner. Alternatively or additionally, the floor cleaning device according to the present invention may be a wet floor cleaning device that cleans the surface using a liquid. The present invention is, however, not limited to the afore-mentioned specific types of floor cleaning devices.

BACKGROUND OF THE INVENTION

Floor cleaning devices often use a powerful rotating brush to boost cleaning performance. The brush rotates rapidly, and the electronics allow high current values before the brush is stopped to make sure that the brush keeps rotating on medium to high pile carpets.

In such kind of floor cleaning device, the rotating brush poses a threat to human, animal and property safety. Specifically, when a user lifts the nozzle of the floor cleaning device where the brush is arranged, fingers, hairs, clothing and much more can be sucked into the nozzle and/or grabbed by the brush.

The brush motor of the floor cleaning device is often powerful enough to inflict injury in such cases, for instance removing skin or chunks of hair. This is a challenge manufacturers of floor cleaning devices need to cope with.

JP 5352389 B2 proposes a floor cleaning device in which the brush motor is turned off in case the nozzle is lifted. While this indeed minimizes the afore-mentioned injury risk, such kind of solution leads to other disadvantages. One of these disadvantages is that the brush motor needs to be stopped and started again every time the nozzle leaves the floor and is afterwards put back on the floor again. This is not only time-consuming but may also decrease the lifetime of the brush motor and at the same time decrease the cleaning performance.

DE 10 2018 119 181 A1 proposes decreasing the brush speed in case the nozzle is lifted. While such kind of solution might be advantageous over a complete shut-off of the brush motor when lifting the nozzle, the afore-mentioned disadvantages still generally apply.

EP 3 316 752 B1 aims at adapting the brush motor control depending on the floor type. However, the focus of the therein disclosed floor cleaning device is not on safety.

DE 10 2007 040484 A1 describes a method for operating a direct current brush motor of a suction blower and/or brush. The motor can be operated in a slow operation mode or a nominal speed range.

SUMMARY OF THE INVENTION

It is an object of the present invention to provide a controller for a floor cleaning device, a nozzle for a floor cleaning device, a floor cleaning device, and a method for controlling a floor cleaning device that overcome the afore-mentioned problems. It is particularly an object of the present invention to provide a floor cleaning device, a nozzle for a floor cleaning device, a floor cleaning device, and a method for controlling a floor cleaning device that mitigate the risk arising from a rotating brush without putting too much strain on the brush motor, and at the same time providing a high cleaning performance.

In a first aspect of the present invention, it is provided a controller for controlling a floor cleaning device that comprises a nozzle configured to contact a floor, a rotatable brush arranged at the nozzle, a brush motor configured to drive the brush to rotation, and a nozzle detector configured to detect whether the nozzle contacts the floor or is lifted from the floor.

The controller is configured to provide control signals to the brush motor to control the rotation of the brush; receive sensor data from the nozzle detector that indicates whether the nozzle contacts the floor or is lifted from the floor; and control the control signals to decrease an upper threshold of a parameter related to a torque of the brush motor, if the sensor data indicates that the nozzle detector detects that the nozzle is lifted from the floor.

In a second aspect of the present invention, a nozzle for a floor cleaning device is provided, the nozzle comprising a rotatable brush, a brush motor configured to drive the brush to rotation, a nozzle detector configured to detect whether the nozzle contacts a floor or is lifted from the floor; and a controller of the aforementioned type.

In a third aspect of the present invention, a floor cleaning device is provided, comprising a nozzle configured to contact a floor; a rotatable brush arranged at the nozzle; a brush motor configured to drive the brush to rotation; a nozzle detector configured to detect whether the nozzle contacts the floor or is lifted from the floor; and a controller of the aforementioned type.

In a fourth aspect of the present invention, a method for controlling a floor cleaning device that comprises a nozzle configured to contact a floor, a rotatable brush arranged at the nozzle, a brush motor configured to drive the brush to rotation, and a nozzle detector configured to detect whether the nozzle contacts the floor or is lifted from the floor is presented, wherein the method comprises controlling the rotation of the brush by means of the brush motor, wherein an upper threshold of a parameter related to a torque of the brush motor is decreased, if it is detected by the detector that the nozzle is lifted from the floor.

In a fifth aspect of the present invention, a computer program product is presented comprising a computer program having a computer program code which, when executed on a computer, is configured to carry out the above-mentioned method.

In contrast to the controllers of the floor cleaning devices disclosed in JP 5352389 B2 and DE 10 2018 119 181 A1, the controller of the floor cleaning device according to the present invention does not stop the brush motor or decrease the speed of the brush in case the nozzle is lifted. Instead, the controller decreases an upper threshold of a parameter related to a torque of the brush motor if lifting of the nozzle is detected. Said threshold may be an upper limit of the parameter related to the torque of the brush motor that said parameter is prevented from exceeding.

This means that an upper limit of the parameter related to the torque of the brush motor is lowered when lifting of the nozzle is detected as compared to a steady state situation where the nozzle is in contact with the floor. In other words, the upper limit that the torque of the brush motor may maximally reach is actively controlled to be lower when the nozzle is lifted from the floor as compared to the upper limit the torque of the brush motor may reach when the nozzle is in contact with the floor.

When the detector detects that the nozzle is lifted from the floor, the power of the brush may be limited to such an extent that can just overcome the rotational resistance of the brush and the brush motor (rotational resistance due to bearings, drive belt etc.). Adding more resistance on the brush, e.g. a finger touching the brush, will cause the brush to come to a standstill unless the detector detects that the nozzle is in contact with the floor again.

Safety is thus significantly increased without the need to stop and start the motor or reduce the speed of the motor every time the nozzle leaves the floor.

The controller may be configured to apply a speed control, said speed control being configured to maintain a substantially constant brush speed. In combination with the above-mentioned control in which the upper threshold of the parameter related to the torque of the brush motor is decreased in case of lifting the nozzle, this leads to a situation where the torque of the brush motor is decreased for safety reasons without slowing down and speeding up the brush every time the nozzle is lifted.

According to an embodiment, the controller is configured (via the control signals) to limit the parameter related to the torque of the brush motor to a first upper threshold, if the sensor data indicates that the detector detects that the nozzle contacts the floor, and limit the parameter related to the torque of the brush motor to a second upper threshold, if the sensor data indicates that the detector detects that the nozzle is lifted from the floor, the second upper threshold being smaller than the first upper threshold.

This allows for situation-dependent obstruction thresholds. Full motor power/torque can be utilized when the nozzle contacts the floor, yet the power/torque of the motor is limited once the nozzle is lifted.

The first upper threshold, which is set when the nozzle is detected to be in contact with the floor, may comprise a plurality of different first upper thresholds that are set by the controller depending on a type of the floor. In other words, the controller adapts the first upper threshold depending on the floor type when the nozzle is detected to be in contact with the floor, whereas the controller sets the second upper threshold, if the detector detects that the nozzle is lifted from the floor, the second upper threshold being smaller than the plurality of first upper thresholds. The floor type may either be detected by means of a floor type detector or input by the user via a user interface (e.g. one or more buttons).

In a further embodiment, the controller may be configured to detect an obstruction of the nozzle based on the parameter related to the torque of the brush motor. In some examples, this is achieved by the controller being configured to: receive parameter data indicating a value of the parameter related to the torque of the brush motor; detect an obstruction of the nozzle based on the parameter related to the torque of the brush motor (e.g., by processing the parameter data); and turn off the brush motor or reduce a brush speed of the rotatable brush responsive to detecting an obstruction of the nozzle (e.g., using the control signals).

The parameter related to the torque of the brush motor may be a brush motor current drawn by the brush motor and/or a brush motor voltage of the brush motor. Thus, the controller may be configured to control, via the control signals, an upper threshold for the current and/or voltage of power drawn by the brush motor responsive to the sensor data produced by the nozzle detector. Thus, a maximum current and/or voltage drawn by the brush motor is reduced responsive to the nozzle being lifted. In this way, a maximum torque that can be applied by the brush motor is reduced when the nozzle is lifted.

In case of an obstruction of the brush, the brush motor current, the brush motor voltage, and the electric power of the brush motor (product of brush motor current and brush motor voltage) will significantly rise. By monitoring the brush motor current and/or the brush motor voltage, an obstruction may thus be easily detected. Thus, the controller may be configured to receive parameter data that indicates a value of the value related to the torque of the brush motor (e.g., a measure or value of the voltage or current drawn by the brush motor).

In a further embodiment, the controller may be configured to turn off the brush motor or to reduce a brush speed of the rotatable brush, if the parameter related to the torque of the brush motor reaches the second upper threshold and/or is kept at the second upper threshold for a predetermined amount of time.

In such case, whenever an obstruction is detected via current sensing or voltage sensing, the brush roll comes to a halt (e.g., as controlled by the controller via the control signals). However, turning off the brush motor if the parameter related to the torque of the brush motor is kept at the second upper threshold for a predetermined amount of time provides the advantage that the brush motor is not turned off in case of smaller obstructions that resolve automatically. Another option apart from turning off the brush motor is to actively slow down the rotatable brush, i.e. to reduce the brush speed, upon an obstruction and then actively drive up the brush speed once the obstruction detection ceases.

Alternatively, the controller may be configured to continue the rotation of the brush while maintaining the parameter related to the torque of the brush motor at the second upper threshold. Hence, even in case of severe obstructions that last for a longer time, the brush motor is not turned off. Once the obstruction is removed, then the brush roll is free and can rotate as before.

In a further embodiment, the floor cleaning device may comprise an underpressure generation unit configured to generate an underpressure at or within the nozzle.

Providing such an underpressure generation unit in addition to the brush may significantly increase the cleaning performance.

According to an embodiment, the nozzle detector may comprise a pressure sensor configured to detect a pressure signal indicative of a pressure within the floor cleaning device, wherein the nozzle detector is configured to determine based on the pressure signal that the nozzle is lifted from the floor.

Said detection may be made based on a predefined change and/or a predefined absolute value of the pressure signal. When the nozzle is lifted from the floor, air flows freely to the underpressure generation unit (e.g. a fan motor) and the underpressure is much lower. In this way, the pressure detector may detect when the nozzle is lifted by detecting a decrease of the pressure signal. It shall be noted that this way of detecting a lifting of the nozzle is generally also possible without an underpressure generation unit included in the floor cleaning device, since also in such case the pressure within the nozzle is changing as soon as the nozzle is lifted from the color.

In a further embodiment, the nozzle detector may comprise a current detector configured to detect a current signal that is indicative of a current drawn by an underpressure generation unit, wherein the nozzle detector is configured to determine based on the current signal that the nozzle is lifted from the floor.

When the air flows more freely, the underpressure generation unit has more resistance because the air is denser. Opposed thereto the density of the air is lower when the nozzle is on the floor such that the resistance in the underpressure generation unit is comparatively small. A lifted nozzle may thus be detected when the current draw of the underpressure generation unit rises above a certain threshold.

In a further embodiment, the nozzle detector comprises an optical sensor configured to detect an optical signal, wherein the nozzle detector is configured to determine based on the optical signal that the nozzle is lifted from the floor.

This optical sensor may be a sensor measuring the amount of ambient light under the nozzle which is only present when the nozzle is lifted. The optical sensor may alternatively include a light source and a detector that detects the amount of reflected light. Further alternatively, the optical sensor may include a time-of-flight sensor which is configured to detect the time it takes for light to be reflected.

In a further embodiment, the nozzle detector may comprise an ultrasonic sensor configured to detect an ultrasound signal, wherein the nozzle detector is configured to determine based on the ultrasound signal that the nozzle is lifted from the floor.

In a still further embodiment, the nozzle detector may comprise a switch arranged at the nozzle, wherein the nozzle detector is configured to determine that the nozzle is lifted from the floor if the switch is actuated.

Such a switch may be arranged underneath the nozzle or integrated into the housing of the nozzle, for instance connected to a wheel of the nozzle.

In a further embodiment, the nozzle detector may comprise an orientation sensor configured to detect an orientation signal indicative of a spatial orientation of the nozzle, wherein the nozzle detector is configured to determine based on the orientation signal that the nozzle is lifted from the floor.

For example, if the nozzle is lifted, it hangs nose-down which can be measured by the angular rotation sensor.

It shall be noted that the above-mentioned different types of detectors, sensors and switches mentioned with respect to the nozzle detector may also be combined in any arbitrary way, i.e. by having one or more of the above-mentioned detectors, sensors and switches of different types included in the nozzle detector.

In a further embodiment, the floor cleaning device may comprise a brush speed sensor configured to detect a brush speed of the rotatable brush, wherein the controller is configured to control the rotation of the brush based on the detected brush speed.

As mentioned above, the controller may be configured to apply a speed control trying to maintain a substantially constant brush speed (both in case the nozzle contacts the floor and in case the nozzle is lifted from the floor). The difference between the nozzle contacting the floor and being lifted from the floor is, however, still that the upper threshold/limit of the parameter related to the torque of the brush motor is set to be lower if the nozzle is lifted from the floor.

It shall be noted that the above-mentioned features and embodiments as well as the features defined in the dependent claims do not only relate to the controller, but similarly to the proposed nozzle, the proposed floor cleaning device, and the proposed method.

Each of the embodiments of vacuum cleaner and/or nozzle may further be battery operated. In other words, any of the vacuum cleaner and/or nozzle embodiments discussed above may further include a battery (not shown in figures). In these battery-operated embodiments, reducing the rotation of the brush (which creates less impact on the torque) is preferred when compared to turning the rotation ON/OFF because turning ON/OFF every time in response to nozzle being lifted decreases battery performance, which is undesirable.

In an embodiment, a floor cleaning device, comprising: a nozzle configured to contact a floor; a rotatable brush arranged at the nozzle; a brush motor configured to drive the brush to rotation; a nozzle detector configured to detect whether the nozzle contacts the floor or is lifted from the floor; and a controller configured to control the rotation of the brush by means of the brush motor, wherein the controller is configured to decrease an upper threshold of a parameter related to a torque of the brush motor, if the detector detects that the nozzle is lifted from the floor.

In a further embodiment, the controller is configured to limit the parameter related to the torque of the brush motor to a first upper threshold, if the detector detects that the nozzle contacts the floor, and wherein the controller is configured to limit the parameter related to the torque of the brush motor to a second upper threshold, if the detector detects that the nozzle is lifted from the floor, the second upper threshold being smaller than the first upper threshold.

In a further embodiment, the controller is configured to detect an obstruction of the nozzle based on the parameter related to the torque of the brush motor.

In a further embodiment, the controller is configured to turn off the brush motor if the parameter related to the torque of the brush motor reaches the second upper threshold and/or is kept at the second upper threshold for a predetermined amount of time.

In a further embodiment, the parameter related to the torque of the brush motor is a brush motor current drawn by the brush motor or a brush motor voltage of the brush motor.

In a further embodiment, the floor cleaning device includes an underpressure generation unit configured to generate an underpressure at or within the nozzle.

In a further embodiment, the nozzle detector comprises a pressure sensor configured to detect an underpressure signal indicative of an underpressure within the floor cleaning device, wherein the nozzle detector is configured to determine based on the underpressure signal that the nozzle is lifted from the floor.

In a further embodiment, the nozzle detector comprises a light-based sensor configured to detect a light-based signal, wherein the nozzle detector is configured to determine based on the light-based signal that the nozzle is lifted from the floor.

In a further embodiment, the nozzle detector comprises an ultrasonic sensor configured to detect an ultrasound signal, wherein the nozzle detector is configured to determine based on the ultrasound signal that the nozzle is lifted from the floor.

In a further embodiment, the nozzle detector comprises a switch arranged at the nozzle, wherein the nozzle detector is configured to determine that the nozzle is lifted from the floor if the switch is activated.

In a further embodiment, the nozzle detector comprises an orientation sensor configured to detect an orientation signal indicative of a spatial orientation of the nozzle, wherein the nozzle detector is configured to determine based on the orientation signal that the nozzle is lifted from the floor.

In a further embodiment, floor cleaning device includes a brush speed sensor configured to detect a brush speed of the rotatable brush, wherein the controller is configured to control the rotation of the brush based on the detected brush speed.

In yet another embodiment, a method for controlling a floor cleaning device is provided. The floor cleaning device includes a nozzle configured to contact a floor, a rotatable brush arranged at the nozzle, a brush motor configured to drive the brush to rotation, and a nozzle detector configured to detect whether the nozzle contacts the floor or is lifted from the floor, the method comprising:

controlling the rotation of the brush by means of the brush motor, wherein an upper threshold of a parameter related to a torque of the brush motor is decreased, if it is detected by the detector that the nozzle is lifted from the floor.

The method is preferably a computer-implemented method.

In yet another embodiment, a computer program product comprising a computer program having a computer program code which, when executed on a computer, is configured to carry out the method of controlling a floor cleaning device is provided. The method is discussed in the preceding paragraph.

Thus, there is provided a computer program product comprising instructions which, when the program is executed by a computer, cause the computer to carry out the steps of any herein described method.

BRIEF DESCRIPTION OF THE DRAWINGS

These and other aspects of the invention will be apparent from and elucidated with reference to the embodiment(s) described hereinafter. In the following drawings.

DETAILED DESCRIPTION OF THE INVENTION

Figure 1:
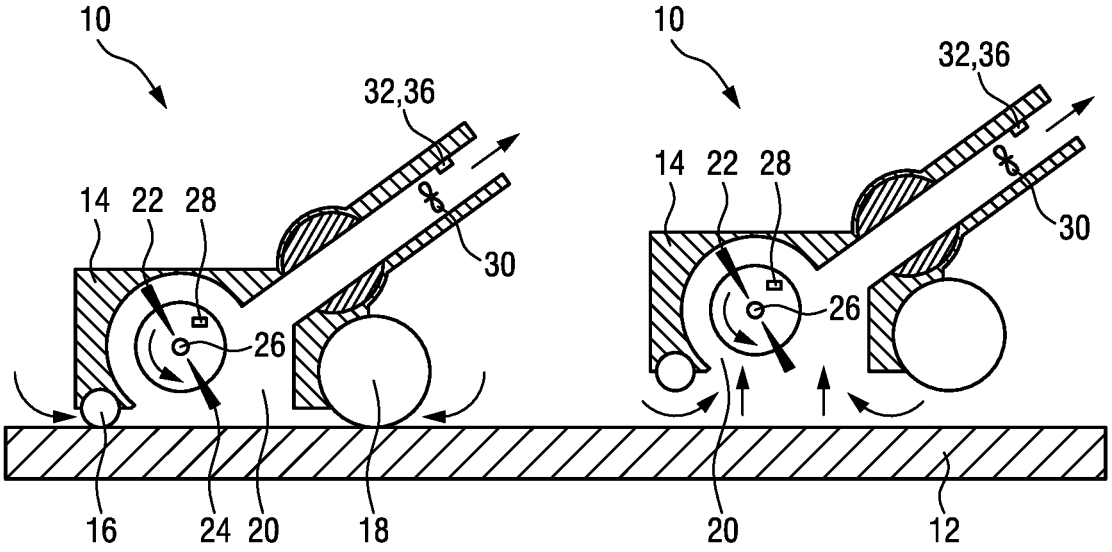
FIG. 1 schematically illustrates a floor cleaning device including a nozzle and a controller according to a first embodiment of the present invention.

FIG. 1 schematically illustrates a first embodiment of the floor cleaning device according to the present invention. The floor cleaning device is therein denoted in its entirety by reference numeral 10. In the left part of FIG. 1, the floor cleaning device 10 is shown in a situation in which it is arranged on a floor 12. The right part of FIG. 1 shows the floor cleaning device 10 in a situation in which it is lifted off the floor 12.

The floor cleaning device 10 comprises a housing 14. On a lower front end of the housing 14 one or more front wheels 16 are arranged. One or more back wheels 18 are arranged on the lower rear side of the housing 14.

The housing 14 forms a nozzle arrangement including a nozzle 20 arranged at the lower side of the housing 14. In the herein shown embodiment, the nozzle 20 contacts the floor 12 via the front and back wheels 16, 18. However, it shall be noted that the nozzle 20 may also directly contact the floor 12 (in case no wheels 16, 18 are provided).

A rotatable brush 22 is arranged at the nozzle 20. In the herein shown embodiment, a major part of the brush 22 is arranged in the interior of the nozzle 20.

The rotatable brush 22 includes a plurality of brush elements 24 arranged to be distributed on a circumferential outer side of the brush 22 and configured to contact the floor 12 during the rotation of the brush 22.

It shall be noted that the present embodiment illustrates only one brush 22, while in practice the nozzle 20 may also include a plurality of brushes.

A brush motor 26 is provided to drive the brush 22 to rotation. Said brush motor 26 may include an electric motor.

Optionally, a brush speed sensor 28 may be provided for detecting a brush speed of the rotatable brush 22. Further optionally, the floor cleaning device 10 may comprise an underpressure generation unit 30 which e.g. comprises a fan motor. This is especially the case if the floor cleaning device 10 is provided as a vacuum cleaner.

The floor cleaning device 10 further comprises a nozzle detector 32 that is configured to detect whether the nozzle 20 contacts the floor 12 or is lifted from the floor 12.

Detecting a floor contact of the nozzle 20 may mean detecting that an underside of the nozzle 20 is in contact with the floor 12 or that the underside of the nozzle 20 is in close vicinity to the floor 12, i.e. less than a predetermined distance (e.g. less than 20 mm or less than 5 mm) to the floor 12. Detecting a floor contact of the nozzle 20 may also mean detecting that the front and back wheels 16, 18 are in contact with the floor. Possible ways of detecting such situations will be elucidated in detail below.

The aforementioned definition of the floor contact detection shall clarify that a floor contact of the nozzle 20 is not necessarily intended to mean any contact, e.g. when the nozzle lays on its back. Such situation would be most probably detected as a lifted state of the nozzle 20. A state, in which the brush 22 is not touching the floor 12, but the nozzle housing 14 is still resting on the floor 12, could similarly be detected as a "lifted nozzle".

Figure 2:
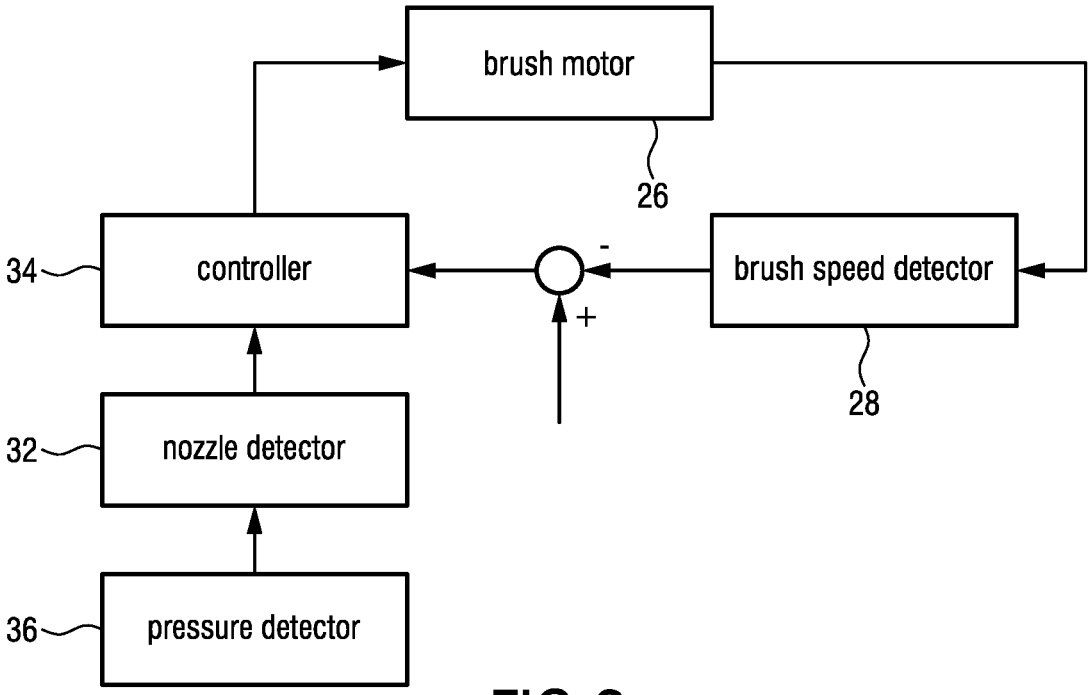
FIG. 2 shows a block diagram of components of the floor cleaning device, particularly illustrating a function of the controller according to the first embodiment of the present invention.

A controller 34 (see FIG. 2) is provided for controlling the rotation of the brush 22 by means of the brush motor 26. In particular, the controller provides control signals for controlling the brush motor 26 to thereby control the rotation of the brush 22. The control signals may define or set one or more parameters for the brush motor (e.g., upper and/or lower limits for certain parameters) and/or directly control the operation of the brush motor. Examples of controllers suitable for performing such procedures are well established.

The controller 34 is configured to control the brush motor 26 responsive to sensor data produced by the nozzle detector 32.

The controller 34 may further be configured to receive speed sensor data from the brush speed sensor and control the brush motor 26 (via control signals) responsive to the speed sensor data, e.g. to ensure that a desired speed is met. Thus, the controller 34 may make use of feedback to ensure a desired speed is achieved.

The controller 34 may apply a speed control that is configured to maintain a substantially content brush speed in both situations, i.e. when the nozzle 20 contacts the floor 12 and when the nozzle 20 is lifted from the floor 12. A steady rpm-setpoint may be predetermined and the controller 34 may strive to maintain it. A pulse-width-modulation (PWM)-signal from the controller 34 may switch MOSFETs (not shown) on and off, supplying 0 V or max Volts from a power supply to the brush motor 26. During the time that these MOSFETs are open, current can flow as drawn by the brush motor 26.

If on hard floor, the PWM may be configured such that the average output voltage delivers the rpm-setpoint. The resistance of the brush on a hard floor is typically low so that not much current is drawn by the brush motor 26.

If on soft floor, the PWM duty cycle is higher so that the higher average voltage delivers the rpm-setpoint. The resistance of the brush 22 is higher so more current is drawn by the brush motor 26. The higher duty cycle increases the on-time of the voltage during which current can be drawn by the brush motor 26 if the brush motor 26 needs it.

If on soft floor with high and thick piles of carpet, then demand for current drawn by the brush motor 26 will increase even more.

The controller 34 is configured to limit the current drawn by the brush motor to a first upper threshold. This means that the controller 34 prevents the brush motor current from increasing above a predefined first maximum current value (first upper threshold). Correspondingly, the torque of the brush 22 is limited to a predefined first upper torque limit.

In case of an obstruction of the brush 22, the brush rotation may thus come to a halt if the braking torque applied by the obstruction of the brush 12 is equal to or larger than the first maximum upper limit torque.

The controller 34 is configured to decrease the upper threshold of the brush motor current to a second upper threshold value that is smaller than the first upper threshold value, if the nozzle detector 32 detects that the nozzle 20 is lifted from the floor 12. Thus, the nozzle detector produces sensor data that is received by the controller 34 and used to control the rotation of the brush 22 via the control signals controlling the brush motor. Preferably, said second threshold is chosen such that the maximum amount of current allowed to be drawn by the brush motor 26 is right enough to overcome the mechanical resistance at the rpm-setpoint. As a consequence, the maximum upper torque that may be provided by the brush motor 26 is limited when the nozzle 20 is lifted from the floor 12. The two threshold values may be chosen/pre-defined in advance by measuring the pressure difference at the brush 22 between the two situations "nozzle on the floor" and "nozzle lifted". The thresholds may be based on this difference with added tolerances based on pollution and production tolerances. The current drawn by the brush motor 26 may be measured when rotating freely. For the determination of the second threshold, the maximum current value may be chosen to exactly fulfill the requirement of rotating the brush 22 freely.

If a user touches the brush 22 with his hand when the nozzle 20 is lifted from the floor 12, the brush rotation will automatically come to a halt without providing an injury risk.

When the lifted state of the nozzle 20 is detected, the current limit of the brush motor 26 is preferably lower significantly to just above the level which is necessary to rotate freely. This means it just keeps rotating when the nozzle 20 is lifted, but when an obstruction is added, the current drawn by the brush motor 26 rises above the second threshold and the rotation of the brush 22 comes to a halt. This basically means that the brush 22 has just enough power to keep rotating freely but nothing left to inflict damage.

When the brush rotation is stopped by the hand of the user or any other obstruction, the brush will begin rotating again, as soon as the finger is taken off the brush 22 again or the other kind of obstruction is dissolved, respectively. However, the controller 34 may also be configured to turn off the brush motor 26 or to reduce the brush speed of the rotatable brush 22, if the brush motor current reaches the second other threshold and/or is kept at the second upper threshold for a predetermined amount of time. This ensures that the brush motor 26 is not working against the obstruction for a long time.

In the first embodiment shown in FIG. 1, the nozzle detector 32 comprises a pressure sensor 36 that detects a pressure signal indicative of a pressure within the floor cleaning device 10. Based on this pressure signal, the nozzle detector 32 may determine that the nozzle 20 is lifted from the floor 12. This is because the underpressure within the floor cleaning device 10 drastically decreases as soon as the nozzle 20 is lifted from the floor, since the air may then flow more freely to the fan motor of the underpressure generation unit 30.

Figure 3:
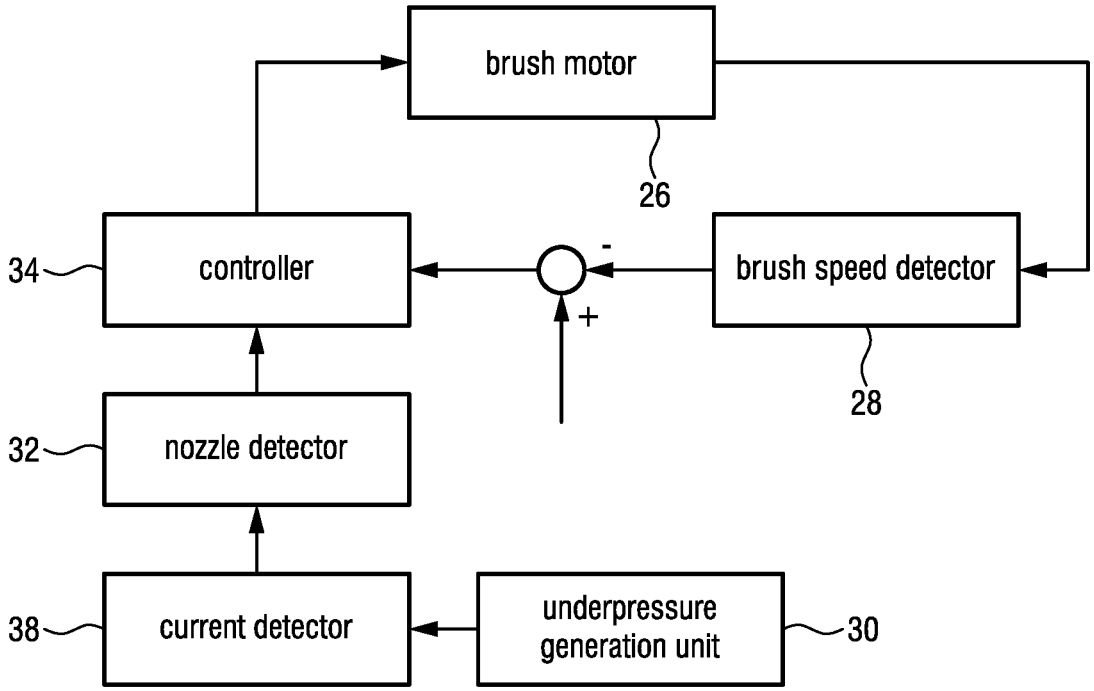
FIG. 3 shows a block diagram of components of the floor cleaning device, particularly illustrating a function of the controller according to a second embodiment of the present invention.

In the second embodiment schematically shown in FIG. 3, the nozzle detector 32 comprises a current detector 38 that detects a current signal indicative of a current drawn by the underpressure generation unit 30. Based on this current signal, the nozzle detector 32 may determine whether the nozzle 20 is lifted from the floor 12 or not. This is because the current motor drawn by the underpressure generation unit 30 typically rises above a certain threshold if the nozzle 20 is lifted from the floor 12, since the air then flows more freely so that the fan has more resistance because the air is denser, as opposed to less dense air when the nozzle 20 is on the floor.

Figure 4:
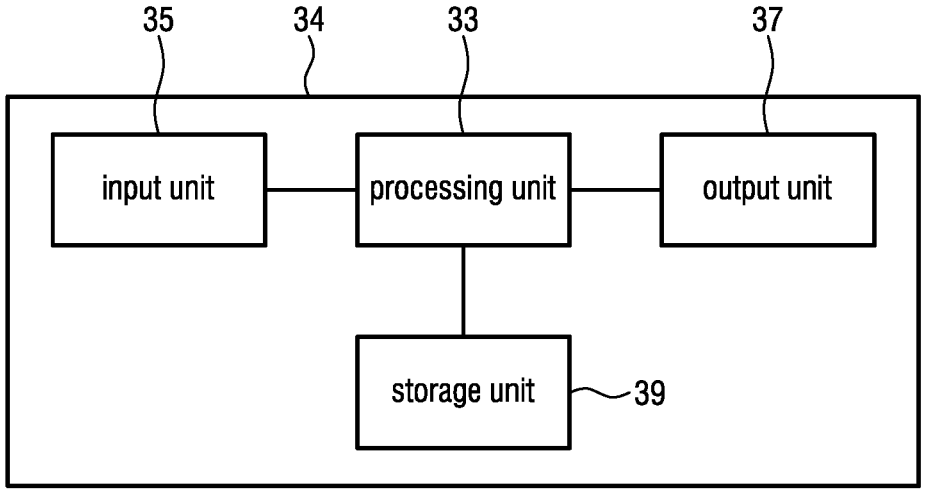
FIG. 4 shows a block diagram that schematically illustrates components of the controller according to a possible implementation of the present invention.

FIG. 4 shows a block diagram that schematically illustrates components of the controller 34 according to a possible implementation of the present invention. The controller preferably comprises electronic circuitry that is configured to carry out the herein mentioned control functions.

In the example shown in FIG. 4, the controller 34 comprises a processing unit 33, an input unit 35, an output unit 37, and a storage unit 39. The input unit 35 is connected to the nozzle detector 32 to receive at least one input signal that is indicative whether the nozzle 20 contacts the floor 12 or is lifted from the floor 12. The processing unit 33 is configured to process said at least one input signal according to a predetermined control logic to determine an output signal that may be used to control the brush motor 26. The control logic may be configured to set an upper threshold of a parameter related to a torque of the brush motor 26 based on the input signal. The output signal may include an indication of said upper threshold. The output unit 37 may be connected to the brush motor 26 to transmit the output signal determined by the processing unit 33 to the brush motor 26. The storage unit 39 may store the predetermined control logic and/or other data necessary for the control.

Figure 5:
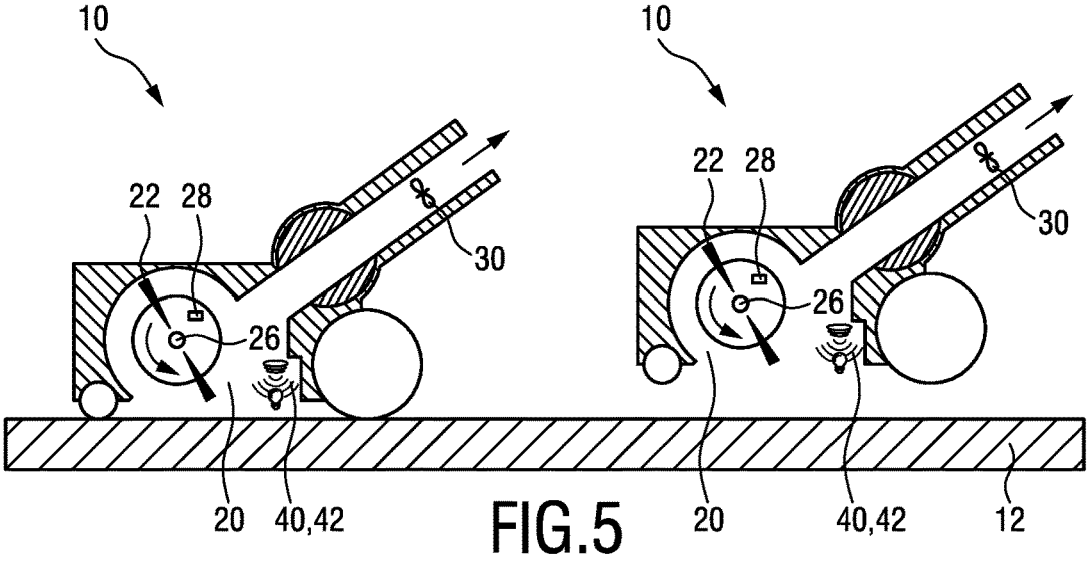
FIG. 5 schematically illustrates the floor cleaning device including a nozzle and a controller according to a third embodiment of the present invention.

It shall be noted that this is only one of a plurality of possible ways of implementing the controller 34. The logical partition in several logical units as described above is not necessarily needed. The controller 34 may instead include only one logical unit that carries out the functions of the aforementioned units 33, 35, 37, 39. Further, some of the aforementioned units 33, 35, 37, 39 and their function may be omitted. FIG. 5 shows a third embodiment of the floor cleaning device 10. In this embodiment, the nozzle detector 32 comprises an optical sensor 40 or an ultrasound sensor 42. The optical sensor 40 may measure the amount of light under the nozzle 20 which is only present when the nozzle 20 is lifted. The optical sensor 40 may alternatively have a light source and measure the amount of light reflected from the floor 12. Furthermore, the optical sensor 40 may include a time-of-flight sensor which measures the time it takes for light to be reflected from the floor 12. In case of the provision of an ultrasound sensor 42, similar measurement principles are possible based on ultrasound.

Figure 6:
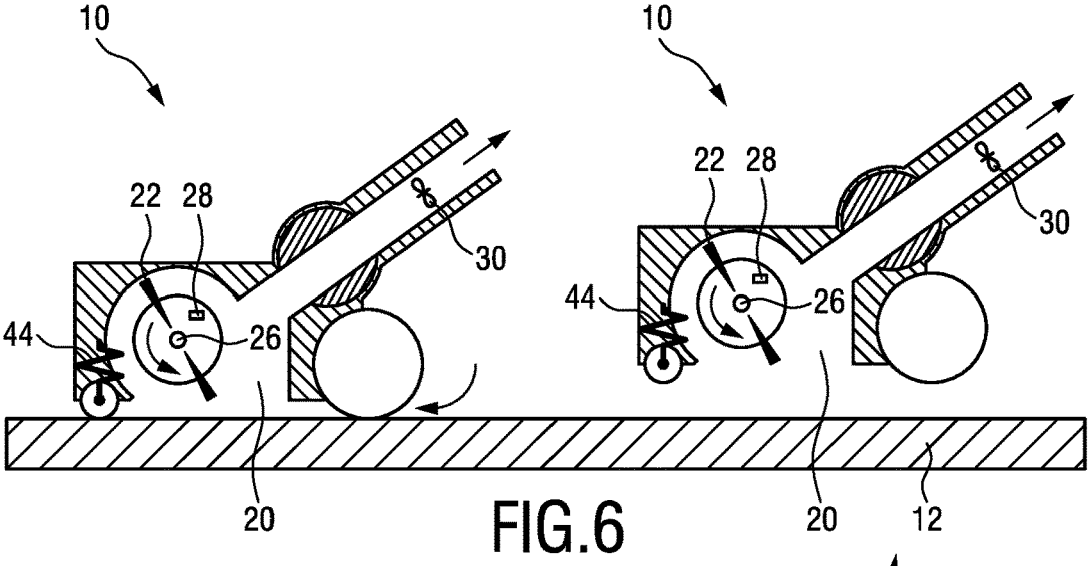
FIG. 6 schematically illustrates the floor cleaning device including a nozzle and a controller according to a fourth embodiment of the present invention.

FIG. 6 shows a fourth embodiment of the floor cleaning device 10. The nozzle detector 32 therein comprises a switch 44 arranged at the nozzle 20. The nozzle detector 32 in this case determines that the nozzle 20 is lifted if the switch 44 is actuated. It is clear that "actuated" in this case may mean both switching the switch 44 from on to off or from off to on.

Figure 7:
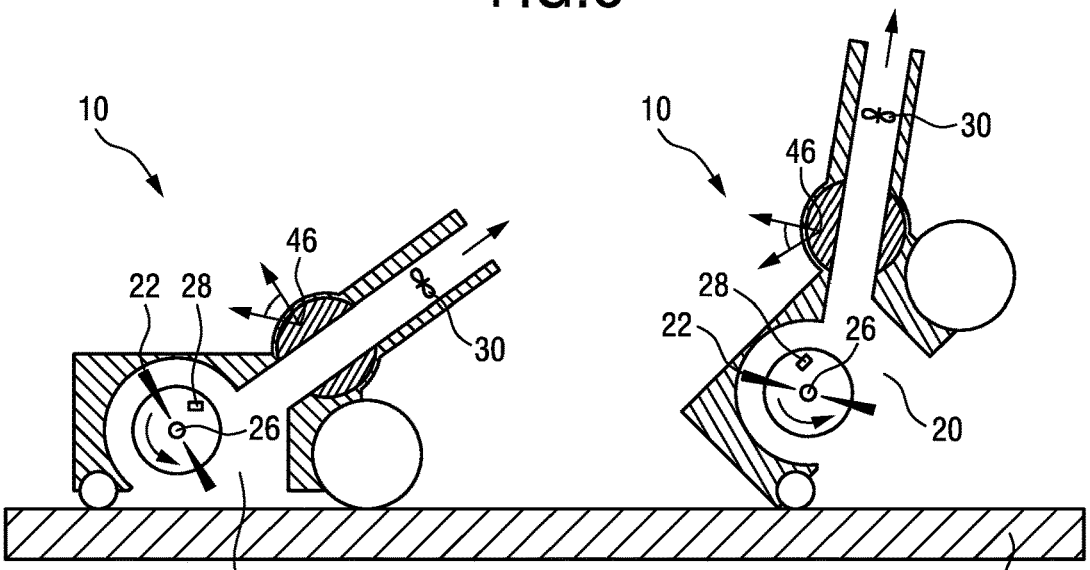
FIG. 7 schematically illustrates the floor cleaning device including a nozzle and a controller according to a fifth embodiment of the present invention.

In the last embodiment shown in FIG. 7, the nozzle detector 32 comprises an orientation sensor 46 that is configured to detect an orientation signal indicative of a spatial orientation of the nozzle 20. The nozzle detector 32 then detects that the nozzle 20 is lifted from the floor 12 if said orientation signal exceeds a predetermined threshold (absolute value/angle or change rate of angle).

The embodiments shown in FIGS. 1-7 may, of course, be combined with one another such that the nozzle detector 32 comprises several different types of sensors and detectors 36-46. Herein, the terms "unit" or "controller" may be replaced with the term "circuit." The terms "unit" or "controller" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The controller 34 may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

The controller 34 may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term "program code", as used herein, may include software, firmware, and/or microcode, and may refer to programs, routines, functions, classes, data structures, and/or objects.

The storage unit 39 may include a nonvolatile memory circuit (such as a flash memory circuit, an erasable programmable read-only memory circuit, or a mask read-only memory circuit), a volatile memory circuit (such as a static random access memory circuit or a dynamic random access memory circuit), a magnetic storage medium (such as an analog or digital magnetic tape or a hard disk drive), and/or an optical storage medium (such as a CD, a DVD, or a Blu-ray Disc). While the invention has been illustrated and described in detail in the drawings and foregoing description, such illustration and description are considered to be illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

Each of the embodiments of vacuum cleaner and/or nozzle may further be battery operated. In other words, any of the vacuum cleaner and/or nozzle embodiments discussed above may further include a battery (not shown in figures). In these battery-operated embodiments, reducing the rotation of the brush (which creates less impact on the torque) is preferred when compared to turning the rotation ON/OFF because turning ON/OFF every time in response to nozzle being lifted decreases battery performance, which is undesirable.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

The invention claimed is:

1. A controller for controlling a floor cleaning device that comprises a nozzle configured to contact a floor, a rotatable brush arranged at the nozzle, a brush motor configured to drive the brush to rotation, and a nozzle detector configured to detect whether the nozzle is lifted from the floor, the controller being configured to:

provide control signals to the brush motor to control the rotation of the brush;

receive sensor data from the nozzle detector that indicates whether the nozzle is lifted from the floor;

control the control signals to decrease an upper threshold of a parameter related to a torque of the brush motor, based on the sensor data indicating that the nozzle is lifted from the floor, to decrease a maximum current or voltage drawn by the brush motor.

2. The controller of claim 1, wherein the controller is configured to, via the control signals:

limit the parameter related to the torque of the brush motor to a first upper threshold, based on the sensor data indicating that the nozzle contacts the floor; and limit the parameter related to the torque of the brush motor to a second upper threshold, based on the sensor data indicating that the nozzle is lifted from the floor, the second upper threshold being smaller than the first upper threshold.

3. The controller of claim 2, wherein the controller is configured to:

receive parameter data indicating a value of the parameter related to the torque of the brush motor; and via the sensor signals, turn off the brush motor or to reduce a brush speed of the rotatable brush, based on the sensor data indicating that the nozzle is lifted from the floor and the parameter data indicates that the parameter related to the torque of the brush motor reaches the second upper threshold and/or is kept at the second upper threshold for a predetermined amount of time.

4. The controller of claim 1, wherein the controller is configured to:

receive parameter data indicating a value of the parameter related to the torque of the brush motor;

detect an obstruction of the nozzle based on the parameter related to the torque of the brush motor; and turn off the brush motor or reduce a brush speed of the rotatable brush responsive to detecting an obstruction of the nozzle.

5. The controller of claim 1, wherein the parameter related to the torque of the brush motor is a brush motor current drawn by the brush motor and/or a brush motor voltage of the brush motor.

6. A nozzle for a floor cleaning device, the nozzle comprising:

a rotatable brush, a brush motor configured to drive the brush to rotation, a nozzle detector configured to detect whether the nozzle contacts a floor or is lifted from the floor; and the controller of claim 1.

7. The nozzle of claim 6, wherein the nozzle detector comprises a pressure sensor configured to detect a pressure signal indicative of a pressure within the floor cleaning device, wherein the nozzle detector is configured to determine based on the pressure signal that the nozzle is lifted from the floor.

8. The nozzle of claim 6, wherein the nozzle detector comprises a current detector configured to detect a current signal indicative of a current drawn by an underpressure generation unit, wherein the nozzle detector is configured to determine based on the current signal that the nozzle is lifted from the floor.

9. The nozzle of claim 6, wherein the nozzle detector comprises an optical sensor configured to detect an optical signal, wherein the nozzle detector is configured to determine based on the optical signal that the nozzle is lifted from the floor.

10. The nozzle of claim 6, wherein the nozzle detector comprises a switch arranged at the nozzle, wherein the nozzle detector is configured to determine that the nozzle is lifted from the floor if the switch is actuated.

11. The nozzle of claim 6, wherein the nozzle detector comprises an orientation sensor configured to detect an orientation signal indicative of a spatial orientation of the nozzle, wherein the nozzle detector is configured to determine based on the orientation signal that the nozzle is lifted from the floor.

12. The nozzle of claim 6, further comprising a brush speed sensor configured to detect a brush speed of the rotatable brush, wherein the controller is configured to control the rotation of the brush based on the detected brush speed.

13. A floor cleaning device, comprising:

a nozzle configured to contact a floor;

a rotatable brush arranged at the nozzle;

a brush motor configured to drive the brush to rotation;

a nozzle detector configured to detect whether the nozzle contacts the floor or is lifted from the floor; and the controller of claim 1.

* * * * *